US008104122B2

(12) United States Patent
Richards et al.

(10) Patent No.: US 8,104,122 B2
(45) Date of Patent: Jan. 31, 2012

(54) PATIENT SUPPORT HAVING AN EXTENDABLE FOOT SECTION

(75) Inventors: Sandy Richards, Pershing, IN (US); Darrell Borgman, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 322 days.

(21) Appl. No.: 11/612,070

(22) Filed: Dec. 18, 2006

(65) Prior Publication Data

US 2007/0136949 A1 Jun. 21, 2007

Related U.S. Application Data

(60) Provisional application No. 60/751,600, filed on Dec. 19, 2005.

(51) Int. Cl.
*A47B 7/02* (2006.01)
*A47B 71/00* (2006.01)
*A47B 7/00* (2006.01)

(52) U.S. Cl. ..... 5/618; 5/600; 5/613; 5/617

(58) Field of Classification Search ..... 5/618, 600, 5/613, 617, 616, 661
See application file for complete search history.

(56) References Cited

U.S. PATENT DOCUMENTS

| | | | |
|---|---|---|---|
| 12,994 | A | 6/1855 | Daniels |
| 585,834 | A | 7/1897 | Ruth |
| 595,734 | A | 12/1897 | Rand |
| 598,054 | A | 1/1898 | Meany |
| 779,576 | A | 1/1905 | Berryman |
| 1,261,040 | A | 4/1918 | Lanes |
| 1,398,203 | A | 11/1921 | Schmidt |
| 1,576,211 | A | 3/1926 | O'Kane |
| 2,245,909 | A | 6/1941 | Enfiajian |
| 2,253,801 | A | 8/1941 | Neal |
| 2,281,209 | A | 4/1942 | Smith |
| 2,284,470 | A | 5/1942 | Comper et al. |
| 2,766,463 | A | 10/1946 | Bendersky |
| 2,452,366 | A | 10/1948 | Frenad |
| 2,556,591 | A | 6/1951 | Loxley |
| 2,564,083 | A | 8/1951 | Stachert |
| 2,605,151 | A | 7/1952 | Shampaine |
| 2,786,214 | A | 5/1955 | Armstrong |
| 2,869,614 | A | 1/1959 | Wamsky |
| 3,003,160 | A | 10/1961 | Goodman |
| 3,010,121 | A | 11/1961 | Breach |
| 3,053,568 | A | 9/1962 | Miller |

(Continued)

FOREIGN PATENT DOCUMENTS

CA 584809 10/1959

(Continued)

OTHER PUBLICATIONS

Porter Group, Mechlok device http://web.archive.org/web/20041217050508/http://www.portergroupllc.com/solutions/mechlok.asp 2 pages, Dec. 2004.*

(Continued)

*Primary Examiner* — Jonathan Liu
(74) *Attorney, Agent, or Firm* — Barnes & Thornburg LLP

(57) ABSTRACT

A patient support having a deck with an adjustable length. The patient support includes a portion configured to extend the length of the deck. The hospital bed is configured to support a bariatric, large, or obese patient.

24 Claims, 8 Drawing Sheets

U.S. PATENT DOCUMENTS

| | | | |
|---|---|---|---|
| 3,099,440 | A | 7/1963 | Burzlaff |
| 3,112,500 | A | 12/1963 | MacDonald |
| 3,138,805 | A | 6/1964 | Piazza |
| 3,195,151 | A | 7/1965 | Boyer |
| 3,210,779 | A | 10/1965 | Herbold |
| 3,220,021 | A | 11/1965 | Nelson |
| 3,220,022 | A | 11/1965 | Nekoa |
| 3,233,255 | A | 2/1966 | Propst |
| 3,239,853 | A | 3/1966 | MacDonald |
| 3,303,518 | A | 2/1967 | Ingram |
| 3,308,489 | A | 3/1967 | Winkler |
| 3,309,717 | A | 3/1967 | Black |
| 3,336,606 | A | 8/1967 | Beitzel |
| 3,406,772 | A | 10/1968 | Ahrent et al. |
| 3,411,766 | A | 11/1968 | Lanigan |
| 3,456,269 | A | 7/1969 | Goodman |
| 3,585,660 | A | 6/1971 | Gottfried et al. |
| 3,640,566 | A | 2/1972 | Hodge |
| 3,665,528 | A | 5/1972 | Kjellberg et al. |
| 3,678,520 | A | 7/1972 | Evans |
| 3,754,749 | A | 8/1973 | Lyon et al. |
| 3,772,717 | A | 11/1973 | Yuen et al. |
| 3,814,414 | A | 6/1974 | Chapa |
| 3,822,425 | A | 7/1974 | Scales |
| 3,845,947 | A | 11/1974 | Lee |
| 3,893,197 | A | 7/1975 | Ricke |
| 3,897,973 | A | 8/1975 | Long et al. |
| 3,905,591 | A | 9/1975 | Schorr et al. |
| 3,916,461 | A | 11/1975 | Kerstholt |
| 3,930,273 | A | 1/1976 | Stern |
| 3,932,903 | A | 1/1976 | Adams et al. |
| 3,958,283 | A | 5/1976 | Adams et al. |
| 3,978,530 | A | 9/1976 | Amarantos |
| 4,002,230 | A | 1/1977 | Schweppe et al. |
| 4,127,906 | A | 12/1978 | Zur |
| 4,139,917 | A | 2/1979 | Fenwick |
| 4,168,099 | A | 9/1979 | Jacobs et al. |
| 4,183,109 | A | 1/1980 | Howell |
| 4,193,149 | A | 3/1980 | Welch |
| 4,206,525 | A | 6/1980 | Williams |
| 4,225,989 | A | 10/1980 | Corbett et al. |
| 4,227,269 | A | 10/1980 | Johnston |
| 4,234,982 | A | 11/1980 | Bez et al. |
| 4,240,169 | A | 12/1980 | Roos |
| 4,258,445 | A | 3/1981 | Zur |
| 4,312,500 | A | 1/1982 | Janssen |
| 4,336,621 | A | 6/1982 | Schwartz et al. |
| 4,369,535 | A | 1/1983 | Ekkerink |
| 4,407,030 | A | 10/1983 | Elliott |
| 4,409,695 | A | 10/1983 | Johnston et al. |
| 4,411,035 | A | 10/1983 | Fenwick |
| 4,453,732 | A | 6/1984 | Assanah et al. |
| 4,477,935 | A | 10/1984 | Griffin |
| 4,483,029 | A | 11/1984 | Paul |
| 4,486,908 | A | 12/1984 | Schroeder |
| 4,525,885 | A | 7/1985 | Hunt et al. |
| 4,527,298 | A | 7/1985 | Moulton |
| 4,534,077 | A | 8/1985 | Martin |
| 4,541,135 | A | 9/1985 | Karpov |
| 4,542,547 | A | 9/1985 | Sato |
| 4,545,084 | A | 10/1985 | Peterson |
| 4,557,471 | A | 12/1985 | Pazzini |
| 4,612,679 | A | 9/1986 | Mitchell |
| 4,628,557 | A | 12/1986 | Murphy |
| 4,633,539 | A | 1/1987 | Morrison |
| 4,634,179 | A | 1/1987 | Hashimoto et al. |
| 4,637,083 | A | 1/1987 | Goodwin |
| 4,638,519 | A | 1/1987 | Hess |
| 4,653,129 | A | 3/1987 | Kuck |
| 4,669,136 | A | 6/1987 | Waters |
| 4,670,923 | A | 6/1987 | Gabriel et al. |
| 4,675,926 | A | 6/1987 | Lindblom et al. |
| 4,682,376 | A | 7/1987 | Feldt |
| 4,685,159 | A | 8/1987 | Oetiker |
| 4,694,515 | A | 9/1987 | Rogers, Jr. |
| 4,694,520 | A | 9/1987 | Paul et al. |
| 4,747,171 | A | 5/1988 | Einsele et al. |
| 4,751,754 | A | 6/1988 | Bailey et al. |
| 4,757,564 | A | 7/1988 | Goodale |
| 4,769,584 | A | 9/1988 | Irigoyen et al. |
| 4,787,104 | A | 11/1988 | Grantham |
| 4,797,962 | A | 1/1989 | Goode |
| 4,799,276 | A | 1/1989 | Kadish |
| 4,803,744 | A | 2/1989 | Peck et al. |
| 4,811,435 | A | 3/1989 | Foster et al. |
| 4,825,486 | A | 5/1989 | Kimura et al. |
| 4,826,529 | A | 5/1989 | Covey et al. |
| 4,838,309 | A | 6/1989 | Goodwin |
| 4,847,929 | A | 7/1989 | Pupovic |
| 4,856,123 | A | 8/1989 | Henderson et al. |
| 4,858,260 | A | 8/1989 | Failor et al. |
| 4,862,529 | A | 9/1989 | Peck |
| 4,862,530 | A | 9/1989 | Chen |
| 4,862,921 | A | 9/1989 | Hess |
| 4,873,734 | A | 10/1989 | Pollard |
| 4,873,737 | A | 10/1989 | Savenije |
| 4,894,876 | A | 1/1990 | Fenwick |
| 4,897,890 | A | 2/1990 | Walker |
| 4,914,760 | A | 4/1990 | Hargest et al. |
| 4,915,124 | A | 4/1990 | Sember, III |
| 4,926,457 | A | 5/1990 | Poehner et al. |
| 4,944,055 | A | 7/1990 | Shainfeld |
| 4,944,060 | A | 7/1990 | Peery et al. |
| 4,949,413 | A | 8/1990 | Goodwin |
| 4,949,414 | A | 8/1990 | Thomas et al. |
| 4,951,335 | A | 8/1990 | Eady |
| 4,953,247 | A | 9/1990 | Hasty |
| 4,967,431 | A | 11/1990 | Hargest et al. |
| 4,968,013 | A | 11/1990 | Kuck |
| 4,974,905 | A | 12/1990 | Davis |
| 4,985,946 | A | 1/1991 | Foster et al. |
| 4,987,623 | A | 1/1991 | Stryker et al. |
| 4,993,920 | A | 2/1991 | Harkleroad et al. |
| 4,998,310 | A | 3/1991 | Olson |
| 4,998,939 | A | 3/1991 | Potthast et al. |
| 5,005,240 | A | 4/1991 | Vrzalik |
| 5,020,176 | A | 6/1991 | Dotson |
| 5,023,967 | A | 6/1991 | Ferrand |
| 5,029,352 | A | 7/1991 | Hargest et al. |
| 5,035,014 | A | 7/1991 | Blanchard |
| 5,036,559 | A | 8/1991 | Hargest |
| 5,040,253 | A | 8/1991 | Cheng |
| 5,044,025 | A | 9/1991 | Hunsinger et al. |
| 5,052,067 | A | 10/1991 | Thomas et al. |
| 5,054,141 | A | 10/1991 | Foster et al. |
| 5,065,464 | A | 11/1991 | Blanchard et al. |
| 5,067,189 | A | 11/1991 | Weedling et al. |
| 5,068,933 | A | 12/1991 | Sexton |
| 5,072,463 | A | 12/1991 | Willis |
| 5,077,843 | A | 1/1992 | Foster et al. |
| 5,083,332 | A | 1/1992 | Foster et al. |
| 5,083,334 | A | 1/1992 | Huck et al. |
| 5,095,561 | A | 3/1992 | Green et al. |
| 5,103,519 | A | 4/1992 | Hasty |
| 5,105,486 | A | 4/1992 | Peterson |
| 5,121,512 | A | 6/1992 | Kaufmann |
| 5,121,513 | A | 6/1992 | Thomas et al. |
| 5,121,756 | A | 6/1992 | Koledin |
| 5,129,115 | A | 7/1992 | Higgins et al. |
| 5,129,117 | A | 7/1992 | Celestina et al. |
| 5,142,719 | A | 9/1992 | Vrzalik |
| 5,148,562 | A | 9/1992 | Borders et al. |
| 5,152,021 | A | 10/1992 | Vrzalik |
| 5,157,787 | A | 10/1992 | Donnellan et al. |
| 5,157,800 | A | 10/1992 | Borders |
| 5,168,589 | A | 12/1992 | Stroh et al. |
| 5,179,744 | A | 1/1993 | Foster et al. |
| 5,191,663 | A | 3/1993 | Holder et al. |
| 5,193,633 | A | 3/1993 | Ezenwa |
| 5,201,102 | A | 4/1993 | McClure |
| 5,205,004 | A | 4/1993 | Hayes et al. |
| 5,230,113 | A | 7/1993 | Foster et al. |
| 5,235,258 | A | 8/1993 | Schuerch |
| 5,235,713 | A | 8/1993 | Guthrie et al. |
| 5,249,319 | A | 10/1993 | Higgs |
| 5,267,364 | A | 12/1993 | Volk |
| 5,279,010 | A | 1/1994 | Ferrand et al. |

| | | | |
|---|---|---|---|
| 5,323,500 | A | 6/1994 | Roe et al. |
| 5,325,551 | A | 7/1994 | Tappel et al. |
| 5,367,728 | A | 11/1994 | Chang |
| 5,377,370 | A | 1/1995 | Foster et al. |
| 5,394,580 | A | 3/1995 | Foster et al. |
| 5,398,354 | A | 3/1995 | Balonick et al. |
| 5,421,046 | A | 6/1995 | Vande Streek |
| 5,450,641 | A | 9/1995 | Montgomery |
| 5,454,126 | A | 10/1995 | Foster et al. |
| 5,469,588 | A | 11/1995 | DiMatteo et al. |
| 5,479,666 | A | 1/1996 | Foster et al. |
| 5,481,769 | A | 1/1996 | Schneider |
| 5,481,772 | A | 1/1996 | Glynn et al. |
| 5,483,709 | A | 1/1996 | Foster et al. |
| 5,530,974 | A | 7/1996 | Rains et al. |
| 5,537,699 | A | 7/1996 | Bonaddio et al. |
| 5,539,942 | A | 7/1996 | Melou |
| 5,542,135 | A | 8/1996 | Ozrovitz et al. |
| 5,542,136 | A | 8/1996 | Tappel |
| 5,557,813 | A | 9/1996 | Steed et al. |
| 5,561,873 | A | 10/1996 | Weedling |
| 5,564,142 | A | 10/1996 | Liu |
| 5,577,279 | A | 11/1996 | Foster et al. |
| 5,586,346 | A | 12/1996 | Stacy et al. |
| 5,603,133 | A | 2/1997 | Vrzalik |
| 5,611,096 | A | 3/1997 | Bartlett et al. |
| 5,623,736 | A | 4/1997 | Soltani et al. |
| 5,634,225 | A | 6/1997 | Miller, Sr. et al. |
| 5,636,397 | A | 6/1997 | Boyd et al. |
| 5,642,546 | A | 7/1997 | Shoenhair |
| 5,666,681 | A | 9/1997 | Meyer et al. |
| 5,678,265 | A | 10/1997 | Meyer |
| 5,699,570 | A | 12/1997 | Wilkinson et al. |
| 5,701,618 | A | 12/1997 | Brugger |
| 5,701,623 | A | 12/1997 | May |
| 5,704,085 | A | 1/1998 | Sabalaskey |
| 5,715,548 | A | 2/1998 | Weismiller et al. |
| 5,745,937 | A | 5/1998 | Weismiller et al. |
| 5,745,942 | A | 5/1998 | Wilkerson |
| 5,781,949 | A | 7/1998 | Weismiller et al. |
| 5,787,531 | A | 8/1998 | Pepe |
| 5,787,532 | A | 8/1998 | Langer et al. |
| 5,794,288 | A | 8/1998 | Soltani et al. |
| 5,802,646 | A | 9/1998 | Stolpmann et al. |
| 5,815,864 | A | 10/1998 | Sloop |
| 5,815,865 | A | 10/1998 | Washburn et al. |
| 5,870,784 | A | 2/1999 | Elliott |
| 5,934,280 | A | 8/1999 | Viard et al. |
| 5,940,910 | A | 8/1999 | Weismiller et al. |
| 5,987,666 | A | 11/1999 | Zigmont |
| 6,021,533 | A | 2/2000 | Ellis et al. |
| 6,089,593 | A | 7/2000 | Hanson et al. |
| 6,115,860 | A | 9/2000 | Vrzalik |
| 6,151,739 | A | 11/2000 | Meyer et al. |
| 6,154,899 | A | 12/2000 | Brooke et al. |
| 6,163,903 | A | 12/2000 | Weismiller et al. |
| 6,212,714 | B1 | 4/2001 | Allen et al. |
| 6,216,300 | B1 | 4/2001 | Hannagan |
| 6,223,369 | B1 | 5/2001 | Maier et al. |
| 6,243,894 | B1 | 6/2001 | Kosumsuppamala et al. |
| 6,253,402 | B1 | 7/2001 | Lin |
| 6,266,833 | B1 | 7/2001 | Lin |
| 6,282,737 | B1 | 9/2001 | Vrzalik |
| 6,295,675 | B1 | 10/2001 | Ellis et al. |
| 6,351,863 | B1 | 3/2002 | Meyer et al. |
| 6,352,240 | B1 | 3/2002 | Eckstein et al. |
| 6,353,948 | B1 | 3/2002 | Bolden et al. |
| 6,357,065 | B1 | 3/2002 | Adams |
| 6,418,579 | B2 | 7/2002 | Perez et al. |
| 6,430,763 | B2 | 8/2002 | Kosumsuppamala et al. |
| 6,438,776 | B2 | 8/2002 | Ferrand et al. |
| 6,467,113 | B2 | 10/2002 | Ellis et al. |
| 6,493,888 | B1 | 12/2002 | Salvatini et al. |
| 6,496,993 | B2 | 12/2002 | Allen et al. |
| 6,499,160 | B2 | 12/2002 | Hand et al. |
| 6,505,368 | B1 | 1/2003 | Ellis et al. |
| 6,530,751 | B1 | 3/2003 | Song et al. |
| 6,536,056 | B1 | 3/2003 | Vrzalik et al. |
| 6,568,013 | B2 | 5/2003 | Perez et al. |
| 6,594,835 | B2 | 7/2003 | West |
| 6,611,979 | B2 | 9/2003 | Welling et al. |
| 6,615,426 | B1 | 9/2003 | Risk, Jr. |
| 6,684,427 | B2 | 2/2004 | Allen et al. |
| 6,739,004 | B1 | 5/2004 | Abrahamsen et al. |
| 6,760,939 | B2 | 7/2004 | Ellis et al. |
| 6,880,189 | B2 | 4/2005 | Welling et al. |
| 6,910,236 | B2 | 6/2005 | Rene |
| 6,968,584 | B1 | 11/2005 | Lafleche |
| 7,000,272 | B2 | 2/2006 | Allen et al. |
| 7,028,358 | B2 | 4/2006 | Liu |
| 7,216,384 | B2 | 5/2007 | Allen et al. |
| 7,260,860 | B2 | 8/2007 | Chambers et al. |
| 2002/0066142 | A1* | 6/2002 | Osborne et al. ..... 5/600 |
| 2004/0255386 | A1* | 12/2004 | Liu ..... 5/710 |
| 2006/0031990 | A1* | 2/2006 | Palmatier et al. ..... 5/611 |

FOREIGN PATENT DOCUMENTS

| | | | |
|---|---|---|---|
| DE | 2310603 | | 9/1974 |
| EP | 0 218 301 | A2 | 4/1987 |
| EP | 0 341 70 | A2 | 11/1989 |
| EP | 0 341 570 | A2 | 11/1989 |
| EP | 0 341 570 | A3 | 11/1989 |
| EP | 0 349 067 | A1 | 1/1990 |
| EP | 0 349 067 | B1 | 10/1990 |
| EP | 0 485 362 | A2 | 5/1992 |
| EP | 0 485 362 | A3 | 5/1992 |
| EP | 0 489 310 | A1 | 6/1992 |
| GB | 122806 | | 2/1919 |
| GB | 159299 | | 2/1921 |
| GB | 141382 | | 7/1921 |
| GB | 189572 | | 12/1922 |
| GB | 298817 | | 10/1928 |
| GB | 2 015 872 | | 9/1979 |
| GB | 2 092 439 | | 8/1982 |
| GB | 2 169 195 | | 7/1986 |
| GB | 2 199 803 | | 7/1988 |
| GB | 2 313 303 | | 11/1997 |
| TW | 200500056 | | 1/2005 |
| WO | WO-91/11617 | | 8/1991 |
| WO | WO-94/09686 | | 5/1994 |
| WO | WO-95/31920 | | 11/1995 |
| WO | WO-96/33641 | | 10/1996 |
| WO | WO-99/15126 | | 4/1999 |

OTHER PUBLICATIONS

Akrotech 4000 Brochure, LUMEX, 1992.

"Impression.TM." Brochure, Kinetic Concepts, Inc., Aug. 1996.

"RemAir ABF Articulating Bariatric Frame"; 2 pages; http://www.mellenair.com/html/bariatric.html: copyright 1999.

Air Flow 5000 Mattress Replacement System, Atlantis Medical, Milltown, NJ, date unknown.

microAIR.TM. 1000, GSI Medical Systems, Carmel, NY, 1989.

Gaymar Sof-Care Plus .COPYRGT. Companion.TM. System, Gaymar Industries, Inc., 1994.

Economic Relief, Bio Therapy.RTM. Plus, Sunrise Medical Bio Clinic, Ontario, CA, date unknown.

Renaissance.TM., Therapeutic Mattress Replacement System, Pegausus Airwave Inc., date unknown.

Apropos, CRS-8500, National Patient Care Systems, date unknown.

ASAP II Therapy System, DynaMedics Corporation, London, ON, Canada, Mar. 1995.

DFS.RTM. Homecare Advanced Dynamic Flotation System, HNE Healthcare, Manalapan, NJ, date unknown.

Tri-Flex II System, CareSelections by Hill-Rom, Bariatric Care, 2004.

First Step, Mattress Replacement System, KCI, San Antonio, TX, 1991.

PRO 2000 MRS, Pneu-Care Series, Cardio Systems, Dallas, TX, date unknown.

Bazooka, Innovative Medical System, Manchester, NH, 1995.

* cited by examiner

PATIENT SUPPORT HAVING AN EXTENDABLE FOOT SECTION

CROSS-REFERENCE TO RELATED APPLICATIONS

This application claims the benefit of U.S. Provisional Patent Application Ser. No. 60/751,600 titled "Patient Support Having An Extendable Foot Section" to Richards et al., filed Dec. 19, 2005, the disclosure of which is expressly incorporated by reference herein.

This application relates to U.S. Provisional Patent Application Ser. No. 60/659,221, titled "Siderail for a Hospital Bed" to Uzzle et al., filed Mar. 7, 2005, the disclosure of which is expressly incorporated by reference herein.

The present application is also related to U.S. patent application Ser. No. 11/073,811, entitled "Hospital Bed", U.S. Patent Application Ser. No. 60/659,368 entitled "Footboard for a Hospital Bed", and U.S. patent application Ser. No. 11/073,795 entitled "Mattress System for a Hospital Bed", all of which were filed on Mar. 7, 2005, all of which are assigned to the assignee of the present invention, and all of which are incorporated herein by this reference.

BACKGROUND

Patient supports, including those used in hospitals, long term care facilities, and for home are used to support a patient and can include support of a bariatric patient. Bariatric beds are designed for use by obese, heavy, or large patients. Bariatric beds typically include a larger than average heavy duty frame to support the patient size and weight. The bed of the present disclosure is configured to support patients up to 1000 pounds, preferably patients between 250 pounds and 1000 pounds, although it is within the scope of the present invention to accommodate patients of greater weights.

SUMMARY OF THE INVENTION

The present invention may comprise one or more of the features recited in the appended claims and/or one or more of the following features or combinations thereof.

The present disclosure relates to a patient support including a frame, a deck, coupled to the frame to support a support surface and configured to move between a first length and a second length, and an extension assembly, operably coupled to the frame. The extension assembly is configured to adjust the deck between the first length and the second length. The extension assembly is adapted to provide heel pressure relief for a patient.

Another embodiment of the present disclosure relates to a patient support comprising a frame, a deck, coupled to the frame to support a support surface. The deck is configured to move between a first length and a second length and a first width and a second width. A length extension assembly is operably coupled to the frame. The extension assembly is configured to adjust the deck between the first length and the second length and is offset from the deck. A width extension assembly is operably coupled to the frame and is configured to adjust the deck between the first width and the second width.

In a further aspect of the present disclosure there is described a bariatric patient support to accommodate bariatric patients of at least four hundred pounds. The bariatric patient support includes a frame and a deck, coupled to the frame to support a support surface. The deck is configured to move between a first length and a second length, and a first width and a second width. The support includes a controller, to control the inflation of the support surface, including a coupler to couple to the support surface.

BRIEF DESCRIPTION OF THE DRAWINGS

The detailed description particularly refers to the accompanying figures in which.

DETAILED DESCRIPTION OF THE DRAWINGS

The embodiments described below and shown in the figures are merely exemplary and are not intended to limit the invention to the precise forms disclosed. Instead, the embodiments were selected for description to enable one of ordinary skill in the art to practice the invention.

Figure 1:
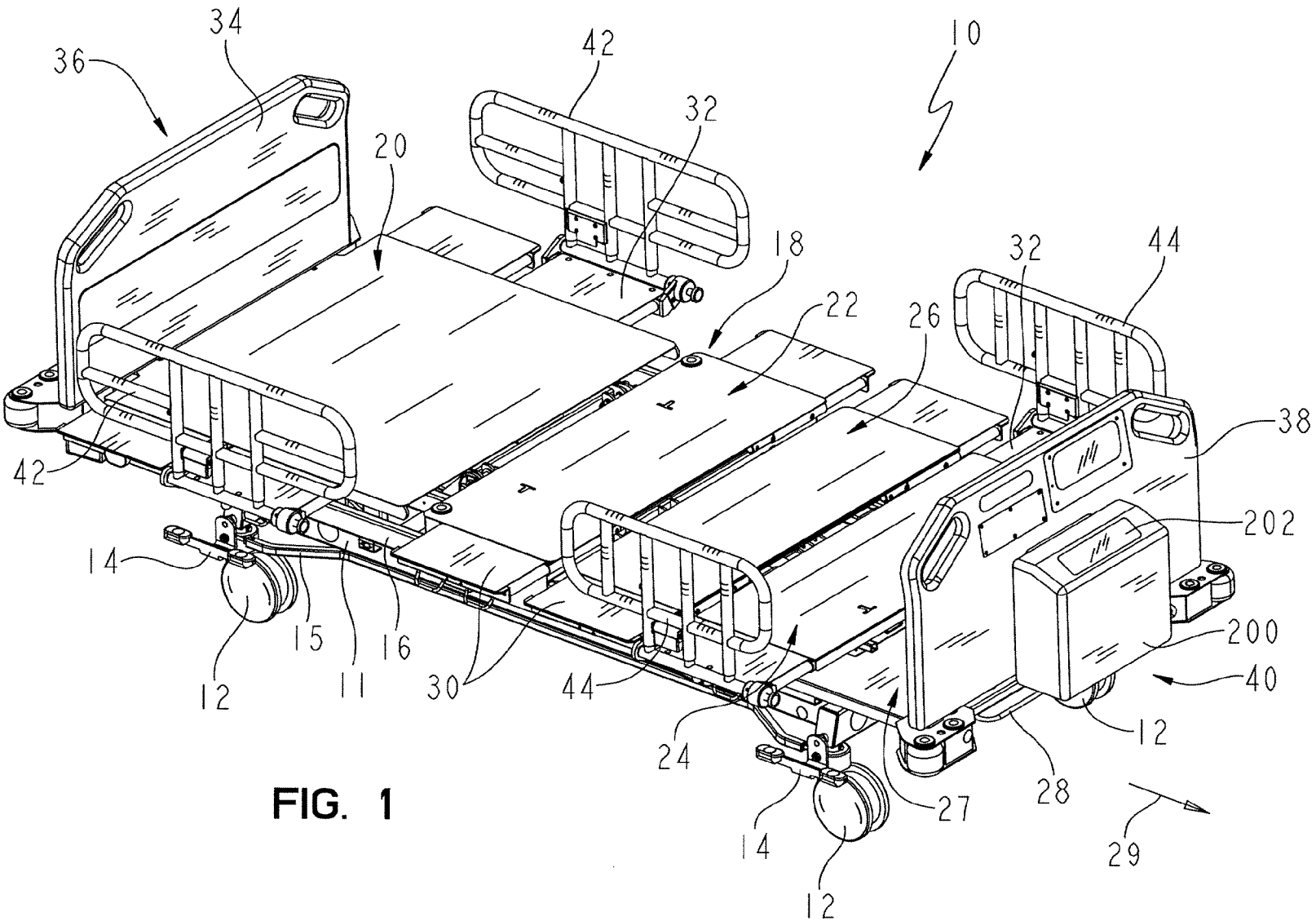
FIG. 1 is a perspective view of an illustrative embodiment patient support.

Referring initially to FIG. 1, a patient support 10 is illustrated as including a base frame 11 supported by a plurality of casters 12 each of which can be locked in place by a brake/steer pedal 14. A connecting rod 15 couples brake/steer pedals 14 though a linkage (not shown). An intermediate frame 16 is supported by the base frame 12 and is coupled to an articulating support deck 18. The support deck 18 includes a plurality of sections configured to articulate relative to one another, including a head section 20 pivotally coupled to a seat section 22, and a foot section 24 pivotally coupled to the seat section 22. In the illustrative embodiment, a thigh section 26 is pivotally coupled intermediate the seat section 22 and the foot section 24. Further illustratively, the seat section 22 may be rigidly mounted to the intermediate frame 16 to prevent movement thereof.

Support deck 18 further includes a deck extension assembly 27 located adjacent the foot section 24. The deck extension assembly 27 can be moved with respect to the foot section 24 through actuation of a release handle 28. Once the release handle is actuated, the deck can be moved in the direction 29 by pulling the assembly 27 with the handle 28. This adjustment of the deck length provides for the accommodation of patients whose height necessitates a longer patient support. The extension of deck extension assembly 27 also lengthens the lower leg and foot area of the bed thereby effectively lengthening the foot section 24. In addition, moving the assembly 27 in a direction opposite the direction 29 can shorten the overall length of the support 10 to accommodate shorter patients. The shorter length can also provide for transport of the support 10 through areas having a dimension insufficient to accommodate an extended support length, such as an elevator.

As illustrated, the top surface of deck extension assembly is offset from the top surface of the foot section 24 in a vertical direction with the foot section surface being higher than the deck extension surface. When the top surfaces of each of the extension assembly and the foot section are substantially parallel, the distance in height between the surfaces can be approximately two to three inches or more. Because each of these sections supports a portion of a support surface placed thereon, the support surface placed on the patient support can have a foot portion of the support surface located slightly lower than an adjacent section. This difference in height of the deck extension to the foot section (also called a "stepdown") has been found to provide heel pressure relief thereby reducing the incidence of decubitus ulcers.

If, however, it is not desired to have a slightly lower foot portion of the support surface, a support surface can be used which includes a pocket at the foot end to accept an insert to compensate for the difference in height. Such a pocket could be sewn into the coverlet to accept a foam insert. The pocket could also be RF welded to the support surface or to the coverlet.

The support deck 18 also includes sliding panels 30 and siderail sliding panels 32 which may be moved laterally to expand and retract the width of the deck 18. Examples of expanding support decks are provided in U.S. Provisional Patent Application Ser. No. 60/591,838, entitled "BARIATRIC BED", filed Jul. 28, 2004 and U.S. Pat. Nos. 6,212,714 and 6,357,065, the disclosures of which are expressly incorporated by reference herein. The sliding panels 30 and siderail sliding panels 32 can be used to adjust the distance between opposed panels or opposed siderails to increase the distance therebetween. In one embodiment, the distance between opposed panels or siderails can be adjusted from approximately 40 inches to approximately 50 inches. The deck provides for a variable distance between panels to provide for the use of an expandable width surface. Such expandable width surfaces include expansion of either foam surfaces and/or by the use of air bolsters or foam bolsters.

A headboard 34 is mounted to the intermediate frame 16 adjacent a head end 36 of patient support 10, and a footboard 38 is mounted to the intermediate frame 16 adjacent a foot end 40 of patient support 10. The patient support 10 further includes a pair of head end siderail assemblies 42 and a pair of foot end siderail assemblies 44 coupled to the support deck 18 through the associated siderail sliding panels 32 on opposite sides of the patient support 10.

Sliding panels 30 and siderail sliding panels 32 and associated head end and foot end siderail assemblies 42, 44 are configured to move between expanded and retracted positions as described in U.S. patent application entitled "Bariatric Bed", filed Jul. 28, 2004, having Ser. No. 60/591,838, U.S. patent application entitled "Hospital Bed", filed Jul. 28, 2005, having Ser. No. 11/191,651, U.S. patent application entitled "Siderail for a Hospital Bed", filed Mar. 7, 2005, having Ser. No. 60/659,221, and U.S. Pat. Nos. 6,212,714 and 6,357,065, the disclosures of which are expressly incorporated by reference herein.

Figure 2:
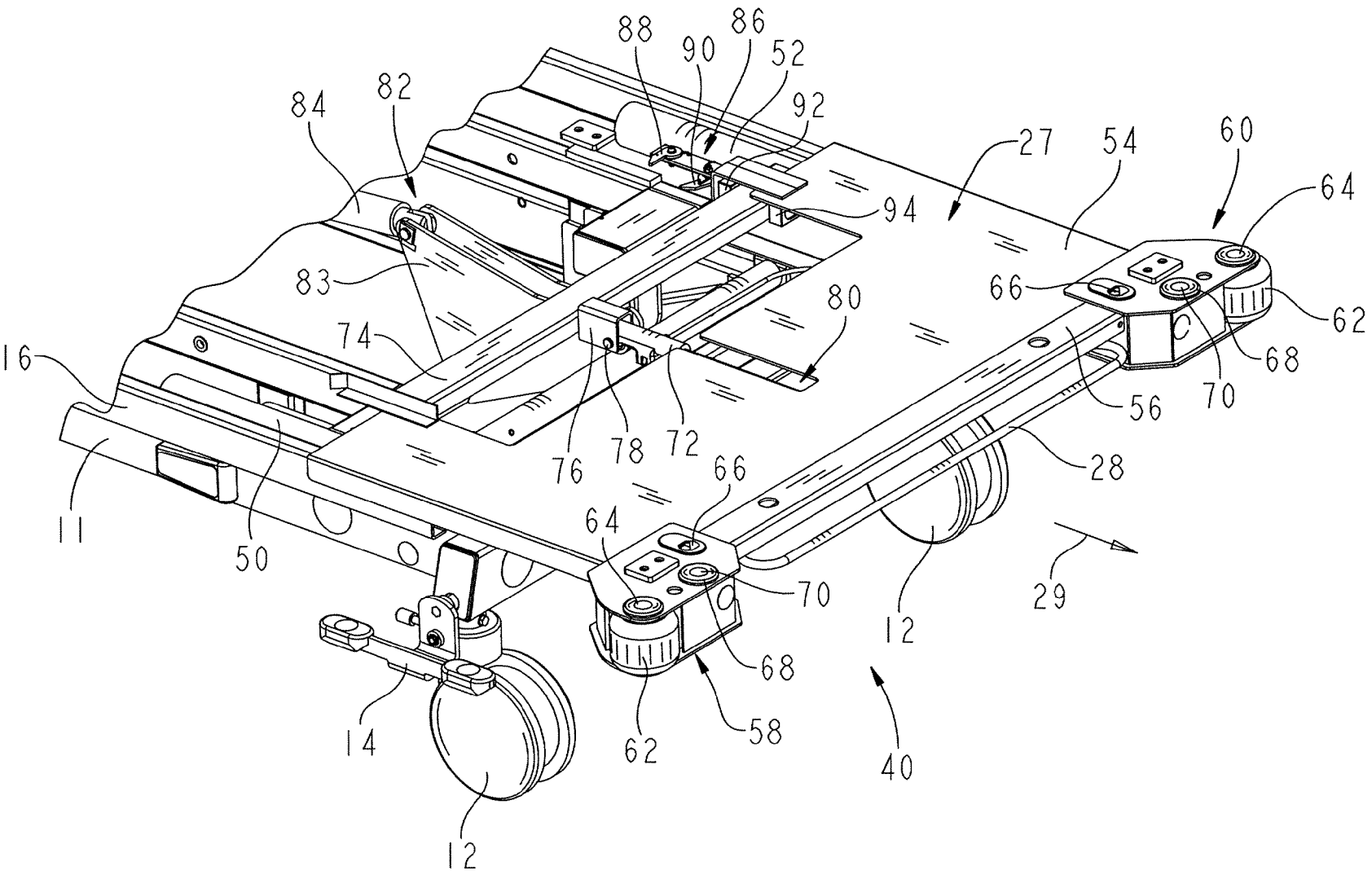
FIG. 2 is a perspective partial view of a foot end of the patient support of FIG. 1.

FIG. 2 illustrates a partial perspective view of the foot end 40 of the patient support 10. As illustrated, the seat section 22, the thigh section 26, and the foot board 38 have been removed to more fully illustrate the deck extension assembly 27. The deck extension 27 is supported by the intermediate frame 16 for sliding movement. Because the deck extension 27 is coupled to the intermediate frame 16, whenever the intermediate frame 16 is placed into a position, the extension 27 is placed in the position as well. For instance, if the intermediate frame is placed in the Trendelenberg position, the extension 27 is placed in the Trendelenberg position. In addition, since the extension 27 is decoupled from the head section 20, seat section 22, foot section 24 and thigh section 26, movement of the these sections can be made independently of the position of the extension 27.

A sliding mechanism includes a first frame slide 50 and a second frame slide 52. The first frame slide 50 and the second frame slide 52 are fixed to the intermediate frame 16 by welding or another known means of attachment. Additional features of the frame slide 50 and 52 are further discussed with respect to FIG. 3.

The extension section 27 includes a section panel 54 coupled to a first frame member 56 to which a first extension bracket 58 and a second extension bracket 60 are coupled. The extension brackets 58 and 60 are also coupled to additional frame members, to be described later, which are substantially perpendicular to the frame member 56. Each of the first extension brackets 58 and 60 include a bumper 62 which is disposed within a recess of the bracket and coupled thereto with a pin 64. The bumper 62 rotates about the pin 64. Each of the extension brackets also includes a footboard socket 66 disposed therein to receive extending pins of the footboard 38 (not shown) which fit within the footboard sockets for support of the footboard. Each of the extension brackets 58 and 60 also include an accessory socket 68 disposed within the extension brackets which include a recess 70 to receive a variety of accessories, including an IV pole.

To adjust the length of the patient support 10, the release handle 28 is moved in an upward direction, substantially perpendicular to the direction 29, such that an extension section lock 72 is released to provide for movement of the deck extension section 27. The lock 72 is coupled to a crossbar 74 coupled to opposite sides of the intermediate frame 16. A bracket 76 attached to the crossbar 74 couples the lock 72 to the frame such that the lock is rigidly connected to the frame with a pin 78. The section panel 54 includes an aperture or groove 80 which is formed into the panel such that movement of the section 27 can be facilitated in a direction opposite the direction 29 to shorten the length of the patient support 10. The groove 80 accommodates the bracket 76 during movement of the section 27. The section 27 can change the outside length of the patient support from approximately 91 inches to 100 inches and provides an inside length between the headboard and footboard of from approximately 80 inches to 88 inches.

FIG. 2 also illustrates a portion of a high-low lift assembly 82, including a lift arm or bracket 83, which is coupled to an actuator 84 for moving the thigh section 26 to a variety of different angles for patient support. Additional features of the high-low lift assembly 82 are illustrated in FIG. 3.

The described embodiment also includes an extension locator 86 which includes a first key mechanism 88 and a second key mechanism 90 which are mounted to the deck extension 27. Movement of the deck extension 27 moves the mechanisms 88 and 90 into contact with a first clicker 92 and a second clicker 94 to indicate to a caregiver or other user when the deck extension section 27 has been moved to a selected location. The clickers 92 and 94 can include in commercially available clicker having a housing supporting a formed piece of metal which provides a "clicking" sound when the metal is moved from a first position to a second position. The clickers 92 and 94 can be appropriately located and mounted to the frame with a double sided tape (not shown).

Figure 3:
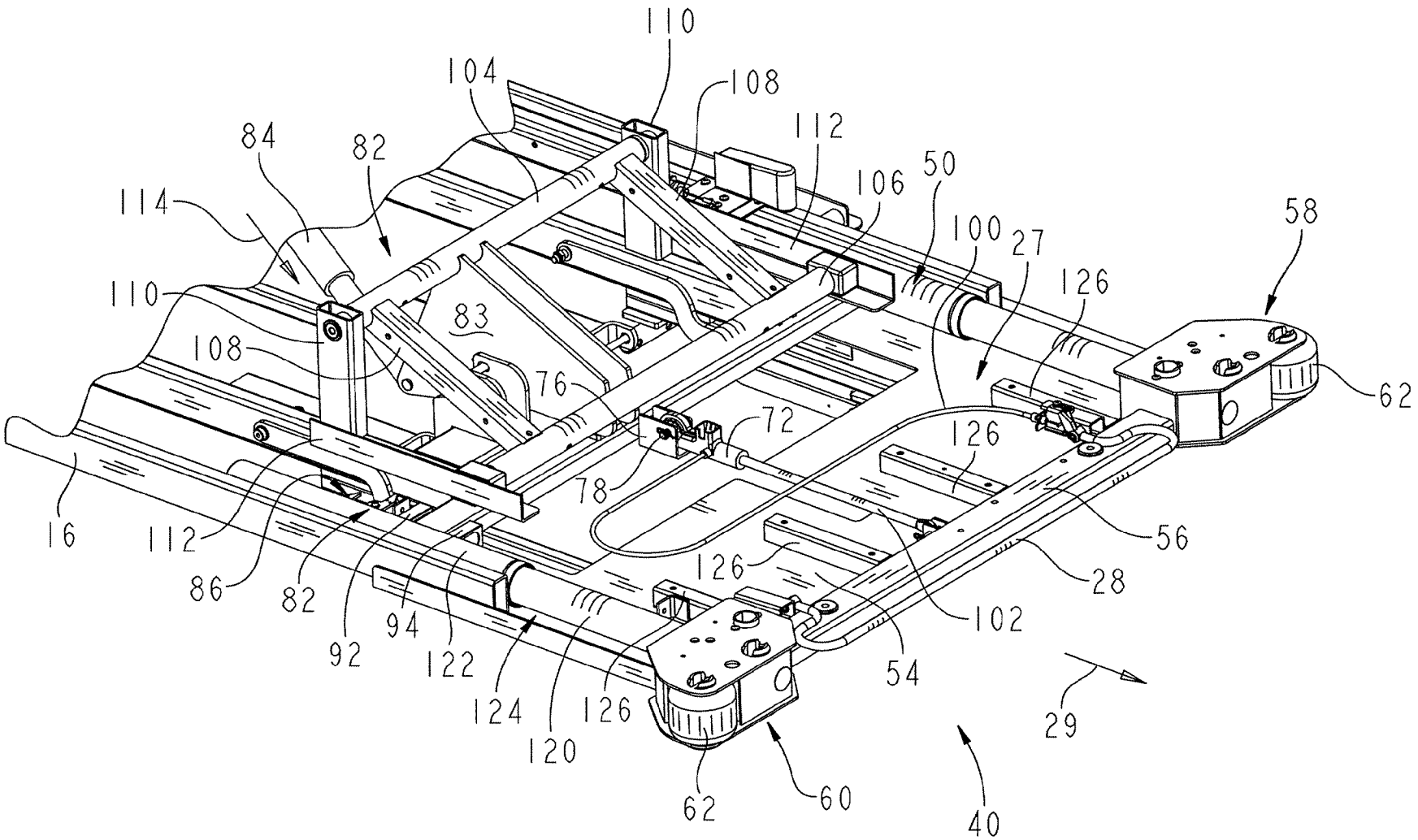
FIG. 3 is an inverted perspective partial view of the foot end of FIG. 2.

FIG. 3 illustrates a perspective view of the foot end of the bed 40 of FIG. 2 in an inverted position to illustrate the underneath side of the foot end 40. As previously described, the release handle 28 is moved to unlock the section lock 72 such that the extension section 27 can be moved in a direction 29 or opposite the direction 29. To unlatch or to release the lock 72, a cable 100 is coupled to and between the lock 72 and the release handle 28. The lock 72 is a mechanical linear locking device and can include a Mechlok® device having an aperture into which a bar 102 is inserted. The Mechlok® device is available from P. L. Porter, Burbank, Calif. The bar 102 which is also coupled to the frame member 56 slides within the lock 72 such that actuation of the cable 100 can fix the lock with respect to the bar 102 thereby holding the frame deck extension section 27 in place. Other locking devices are within the scope of the present disclosure. In addition, the Mechlok® device could be electrically actuated, for instance with a solenoid, by the push of a user accessible button as would be understood by one skilled in the art.

Also illustrated in FIG. 3 is the high-low lift assembly 82 including the lift arm or bracket 83 coupled to the actuator 84 as previously described. The high-low lift assembly 82 is coupled to a top panel of the thigh section 26, a portion of which is illustrated in FIG. 3. The assembly 82 includes a frame having a first bar 104 coupled to a second bar 106 with the bracket 83 as illustrated. Additional frame members 108, 110 and 112 are included. To adjust the level of the thigh section 26, the actuator 84 which is coupled to the bracket 83 moves the entire high low lift apparatus 82 in a direction 114. Movement in the direction 114 provides for elevation of the knees of the patient as well as other known supporting positions to provide for positioning of the patient in a variety of positions.

The frame slide 50 and 52 previously shown in FIG. 2, are more fully illustrated in FIG. 3. As the frame slide 50 and 52 both include substantially the same components, the following description while discussing only the frame slide 52 applies equally as well to the frame slide 50. The frame slide 52 includes a first tube 120 which is slidingly received within a second tube 122. The second tube 122 is fixed to the intermediate frame 16 as previously described. The first tube 120 is coupled to and fixed to the extension bracket 58. The first tube is attached to the extension bracket 58 such that a space 124 is maintained between the first tube 120 and the underneath side of the section panel 54. In this fashion, the first tube 120 can slide back and forth within the second tube 122 in a relatively unencumbered fashion.

As also illustrated in FIG. 3 the deck extension section 27 includes additional frame members 126 which extend from the frame member 56 in a direction substantially perpendicular thereto. The frame members 126 are coupled to the section panel 54 such that the frame members as well as the extension bracket and the section panel provide a relatively stable and rigid deck extension section 27.

Figure 4:
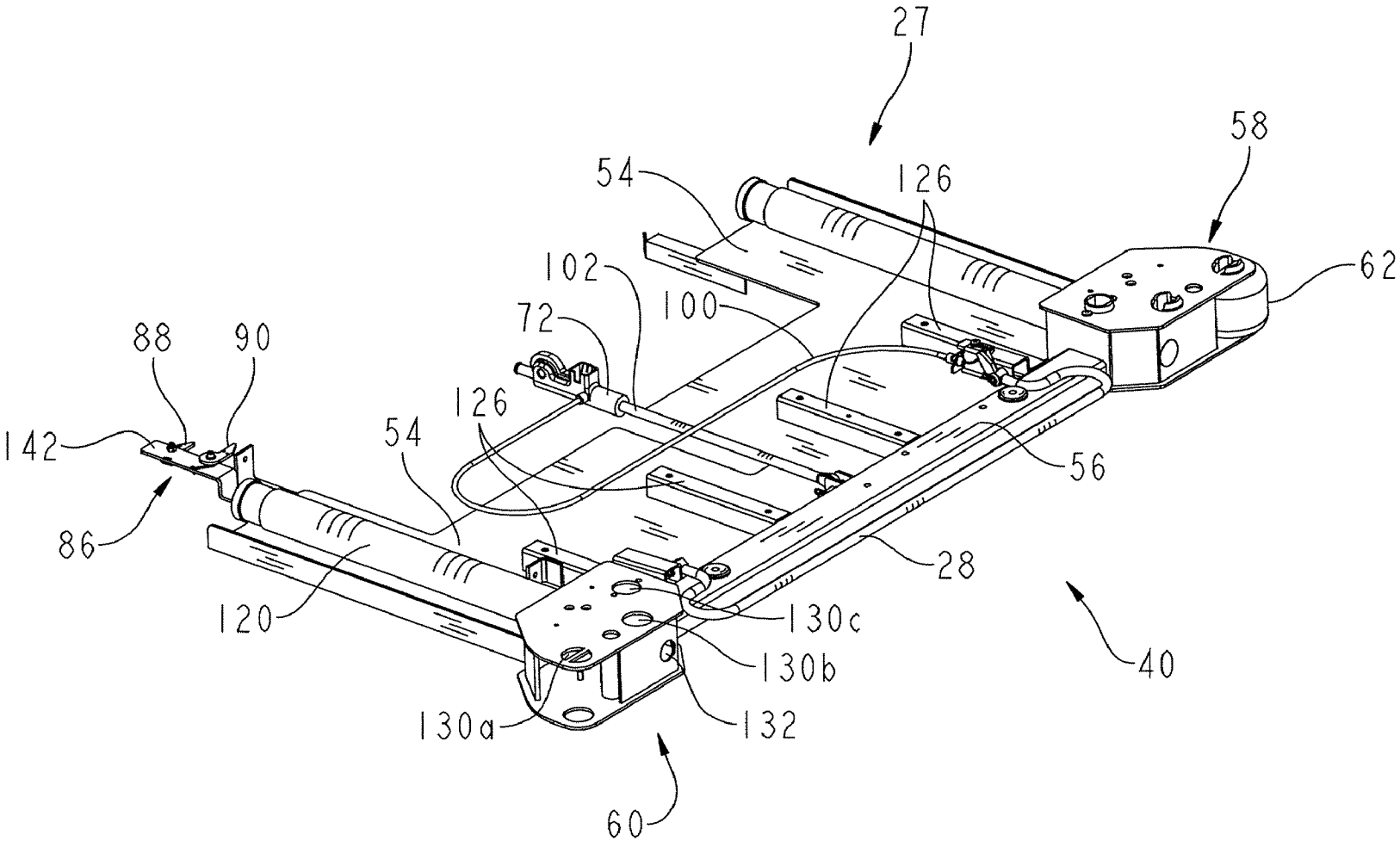
FIG. 4 is an inverted perspective partial view of a deck extension assembly.
Figure 5:
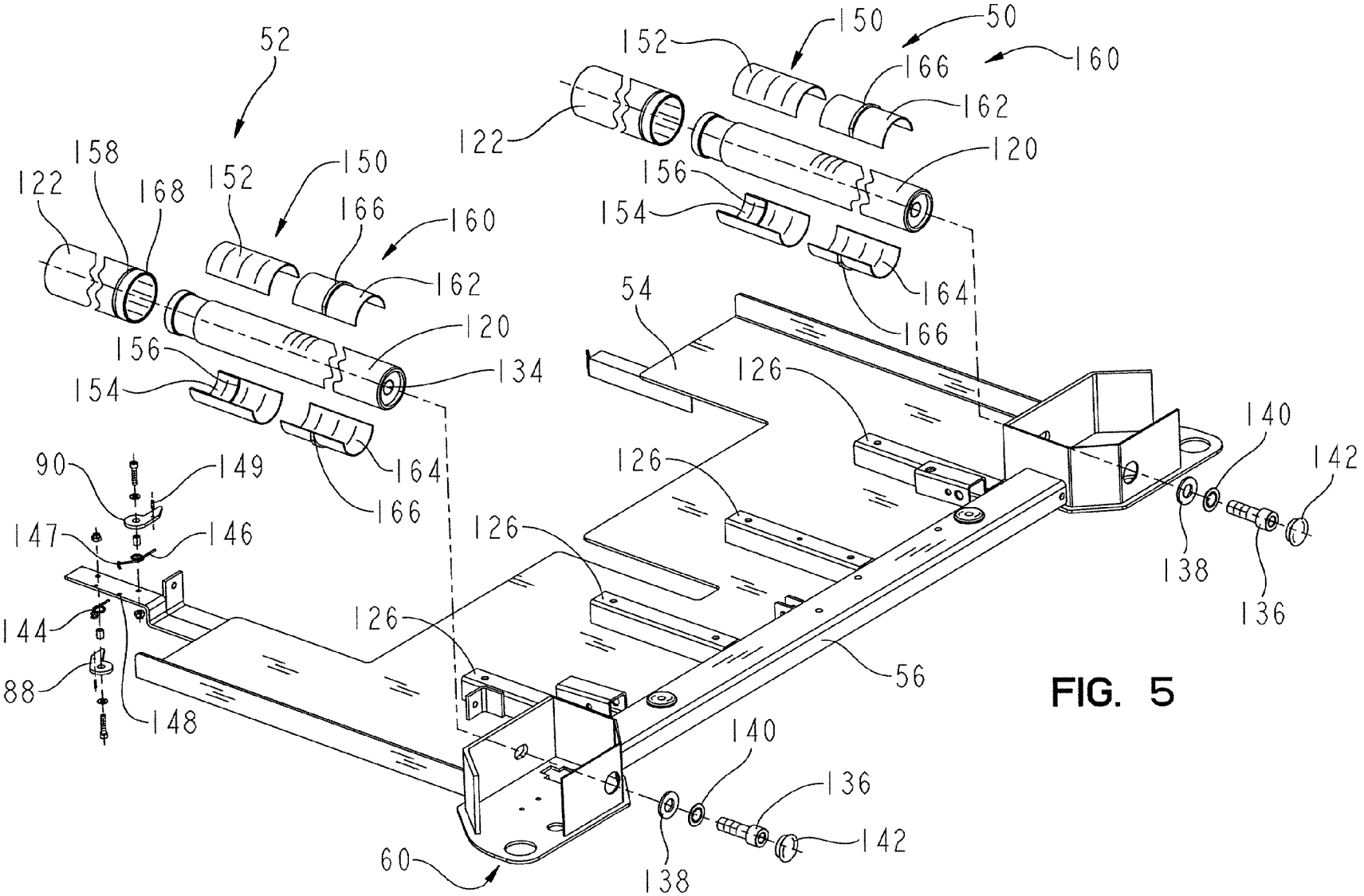
FIG. 5 is an inverted perspective partial view of the deck extension assembly of FIG. 4 including an exploded view of a frame slide.

Referring to now to FIG. 4 and to FIG. 5, additional details of the deck extension 27 are illustrated. As can be seen, a left illustrated extension bracket 60 is shown to not include the bumper 62, the pin 64, the footboard socket 66 and the accessory socket 68. The extension bracket includes a plurality of apertures 130*a*, 130*b*, and 130*c* which respectively receive the pin 64, the accessory socket 68, and the footboard socket 66. The extension bracket is formed with apertures configured such that the pin 64, accessory socket 68, and footboard socket 66 can be press fit or snap fit therein for assembly. The extension bracket 60 also includes an aperture 132 which is used to couple the first tube 120 thereto. As further illustrated in FIG. 5, the first tube 120 includes an aperture 134 into which a pin 136 is inserted. The pin 136 passes through a first washer 138 and a second washer 140, before being inserted through the aperture 132 and into the aperture 134 of the first tube. A button 142 is coupled to the head of the pin 136 to provide for a smooth and finished look to the extension bracket 60.

As further illustrated in FIG. 4 the extension locator 86 is coupled to the deck extension section 27 through a bracket 142. The first key 88 is coupled to one side of the bracket 142 and the second key 90 is coupled to the opposite side of the bracket 142. As further illustrated in FIG. 5 each of the first key 88 and second key 90 are coupled to the bracket 142 with a connecting mechanism which is inserted through an aperture in the key and then through a first spring 144 and a second spring 146 respectively. The assembly of the bracket 142 for the first key 88 and second key 90 is substantially the same. A spring, for instance spring 146, includes an end 147 which is inserted into an aperture 148 to fix the spring with respect to the bracket 142. An opposite end of the spring abuts against a pin 149 which is coupled to or fixed to the key by being inserted into an aperture formed in the key.

As previously described with respect to FIG. 2 and FIG. 3, movement of the deck extension section 27 moves the keys in the direction 29 or opposite thereto such that the keys contact one or two clickers 92 and 94. The sound provided by the clickers upon the keys contacting the clickers provides an indication to the caregiver that the extension section 27 has been moved to a predetermined location. It is within the scope of the present invention to use other mechanical indicators as well as to use electrical indicators as would be understood by those skilled in the art.

FIG. 5 also illustrates a perspective exploded view of the frame slide 50 and frame slide 52. As previously described, each of the frame slides 50 and 52 can be constructed substantially the same such that only one is described for purposes of the present disclosure. For instance, the frame slide 52 includes the first tube 120 which is inserted into the second tube 122. A first keeper 150 includes a first keeper section 152 and a second keeper section 154 which cooperate to surround a portion of the first tube 120 and second tube 122. The first keeper section 154 includes a raised portion 156, which is also located on the section 152 (not shown). The raised portion 156, which is located on an interior surface of sections 152 and 154, cooperates with a groove 158 formed in the second tube 122. The cooperating raised portion 156 and groove 158 provide to maintain the first keeper 150 fixed with respect to the tube 122 once the first keeper 150 is securely attached to the tube 122. A second keeper 160 includes a first portion 162 and a second portion 164 which cooperate to surround a portion of the first tube 120. Both the first portion 162 and second portion 164 include a raised portion 166 located on the exterior thereof. The second keeper 160 is fixed to the first tube 120 at a location which prevents the deck extension section 27 from being pushed too far towards the center of the patient support 10. The movement of the section 27 is limited by the portion 166 contacting an end 168 of tube 122 and is provided by the raised portion 166 contacting an end portion of the first keeper 150.

Figure 6:
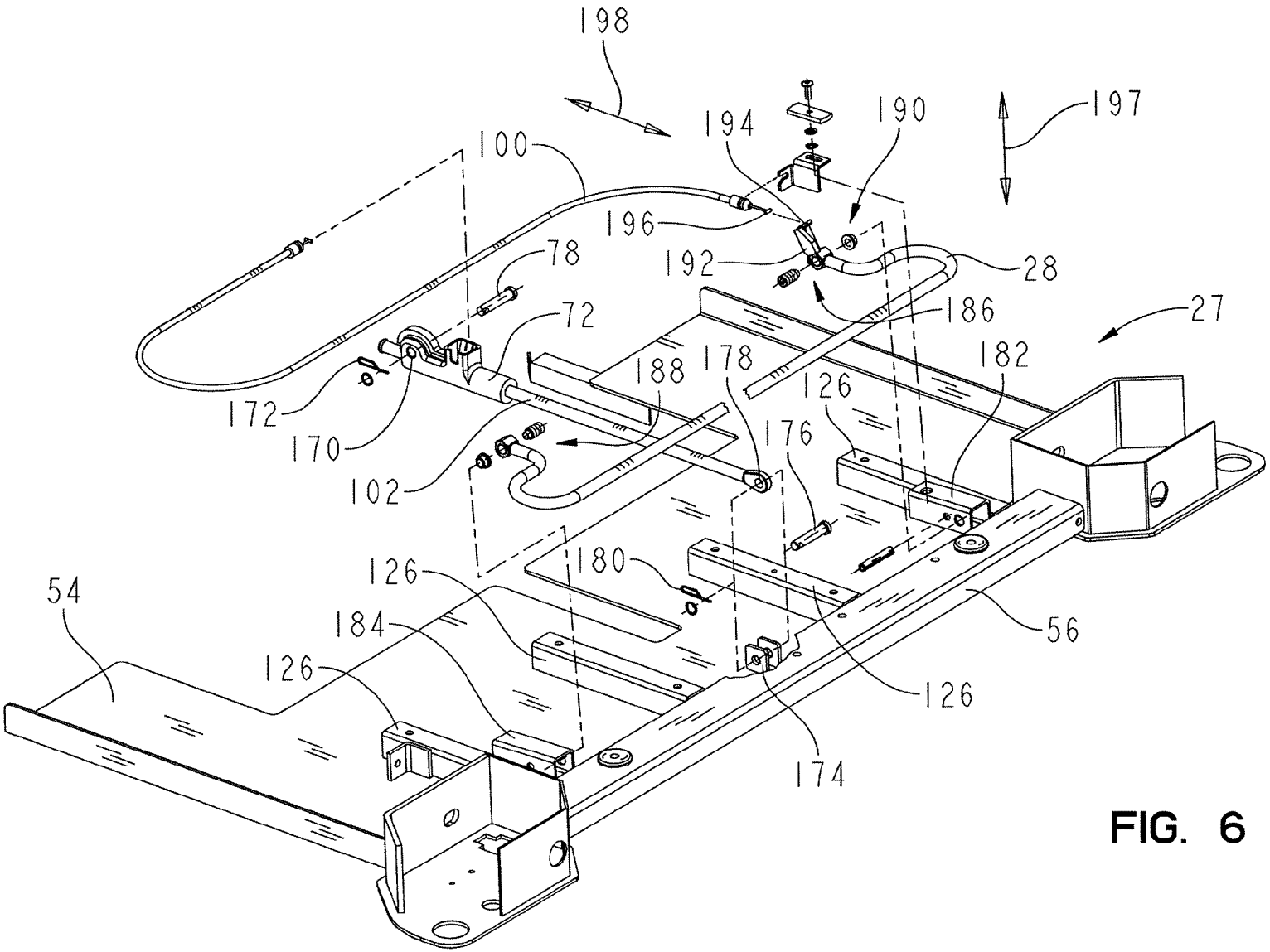
FIG. 6 is an inverted perspective partial view of the deck extension assembly of FIG. 4 including an exploded view of a release handle.

FIG. 6 illustrates a perspective view of the deck extension section 27 illustrating in more detail the release handle 28, the lock 72, the cable 100, and the bar 102. As previously described, the lock 72 is coupled to the bracket 76 (see FIG. 2) with a pin 78. The pin 78 is inserted through an aperture 170 and held in place by a pin 172 inserted therethrough. The bar 102 extends through the length of the lock 72 for a sliding fit therewith. The opposite end of the bar 102 is coupled to a bracket 174 fixedly secured to the extension section 27 with a pin 176 inserted through the bracket 174 and an aperture 178 of the bar 102. The pin 176 is held in place with a pin 180.

The release handle 28 is rotatably secured to a first bar bracket 182 and a second bar bracket 184 with respective connectors 186 and 188. The first and second bar brackets 182 and 184 are coupled to frame member 56. At an end 190 of the bar 28, a connecting member 192 includes a cut out or an aperture 194 adapted to receive an end 196 of the cable 100. The connector 194 is positioned at an angle with respect to a movement direction of the bar 28 such that movement of the bar 28 in a direction(s) 197 moves the connector in a direction(s) 198. Consequently, the up-down motion of the bar 28 creates a back and forth motion of the connector 194 such that the cable end 196 adjusts cable 100 to close or to release the locking mechanism of the lock 72. By this mechanism, movement of the extension section 27 in the direction 29 can be stopped by closure of the lock mechanism 72 or enabled by opening the lock 72.

As has been previously described, the deck extension section 27 can be moved in a direction to minimize the overall length of the patient support 10. Because the patient support 10 can include the use of a low air loss therapy surface, which is typically inflated to support a patient, or a foam support surface, which may include an inflatable foot portion, each of these support surfaces can be prepared to facilitate transportation of the support 10. In the case of the low air loss therapy surface, a controller 200 (see FIG. 1) includes a user interface 202 having a selector or input which provides for transportation by requesting whether or not a patient is to be transported. If a patient is to be transported, the control system embodied with the controller 200 deflates the support surface such that the support surface can be shortened in length and/or width when the extension section 27 is moved towards the center of the patient support 10. In one embodiment of the present embodiment, the deflate mode stands ready for 30 minutes at which point an alarm sounds indicating that the inflate/deflate mode is still in operation. If, however, a foam support surface is being used which includes an inflatable foot portion, the control system provides for deflation of the foot portion by selection of a foot deflate mode through the user interface 202. Once the foot section has been deflated, the extension section 27 can again be moved towards the center of the patient support for transport.

Figure 7:
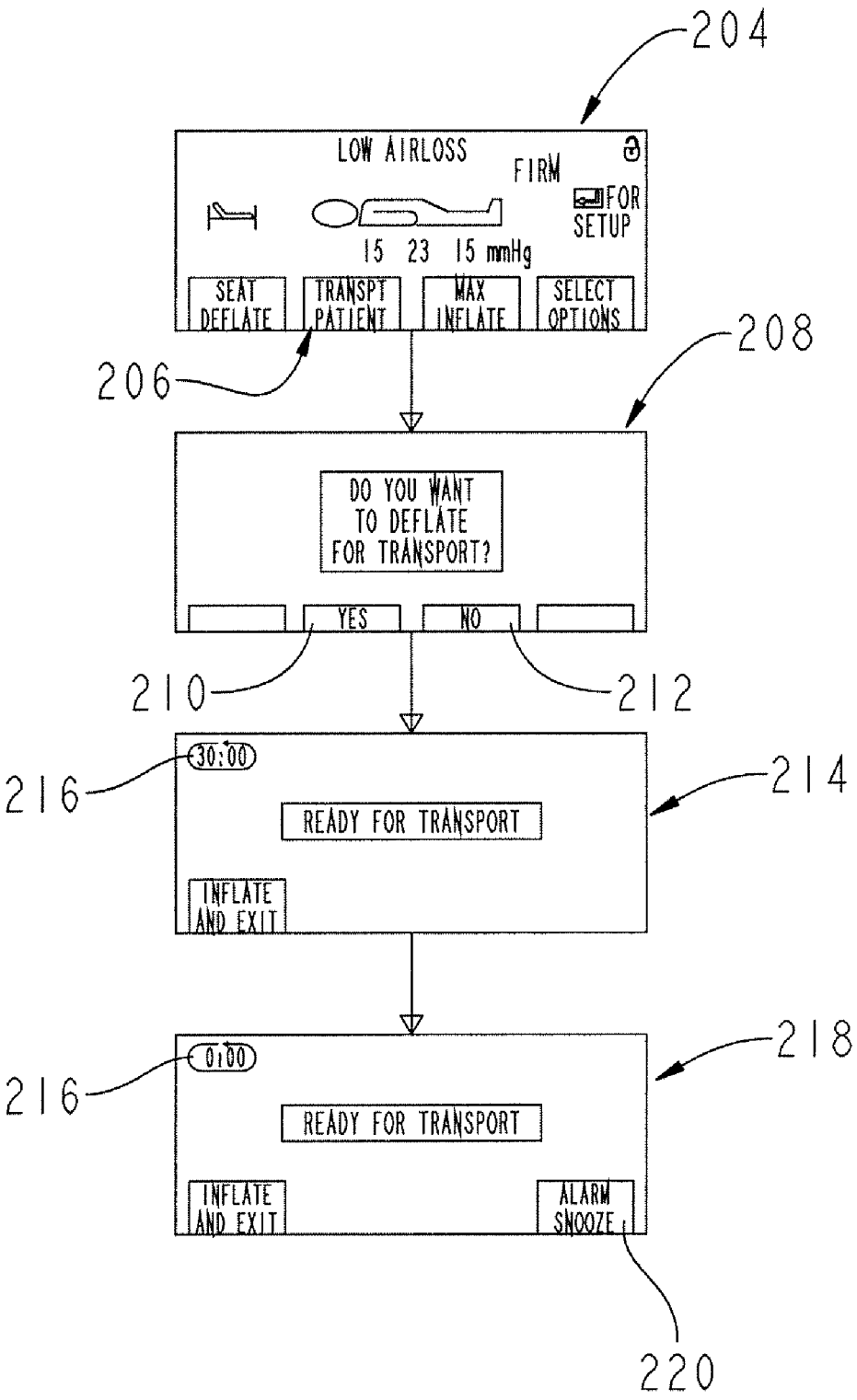
FIG. 7 is a flowchart illustrating a method of preparing a patient support including an inflatable support surface for transport.

FIG. 7 is a flowchart illustrating a method of preparing the patient support 10 having an inflatable support surface for transport. During operation of the patient support 10, the user interface 202 can display a screen 204 which includes a plurality of user selectable inputs including a transport input 206. Upon selection of the transport input 206, the user interface displays a display screen 208, which asks the user to confirm whether transport is requested by displaying the phrase "Do you want to deflate for transport". If yes, the YES input 210 is selected as screen 208. If no, the NO input 212 is selected. Assuming the YES input 210 is selected, the display screen 214 is displayed by the display screen 204. At this point, the controller 200 deflates the side bolsters, if present in the support surface, and the foot section of the support surface. Once deflated, the caregiver may move the extension assembly toward the center of the patient support to decrease the length of the bed. Likewise, if the sides are deflated the sliding panels 30 and sliding siderail panels 32 can be moved towards the center of the patient support.

A timer 216 is displayed in the display screen 214 with a time period during which transport can occur. In this case, the timer 216 is a countdown timer which is originally set to thirty minutes. Other time periods are within the scope of the present disclosure. Once the time counts down to zero, as shown at display 218, an alarm sounds indicating that the time period has expired. Once expired, the caregiver or user can either select an alarm snooze input 220 if transport can still occur or an inflate and exit input 222 which inflates the support surface to the previous inflated condition of the support surface before transport began.

Figure 8:
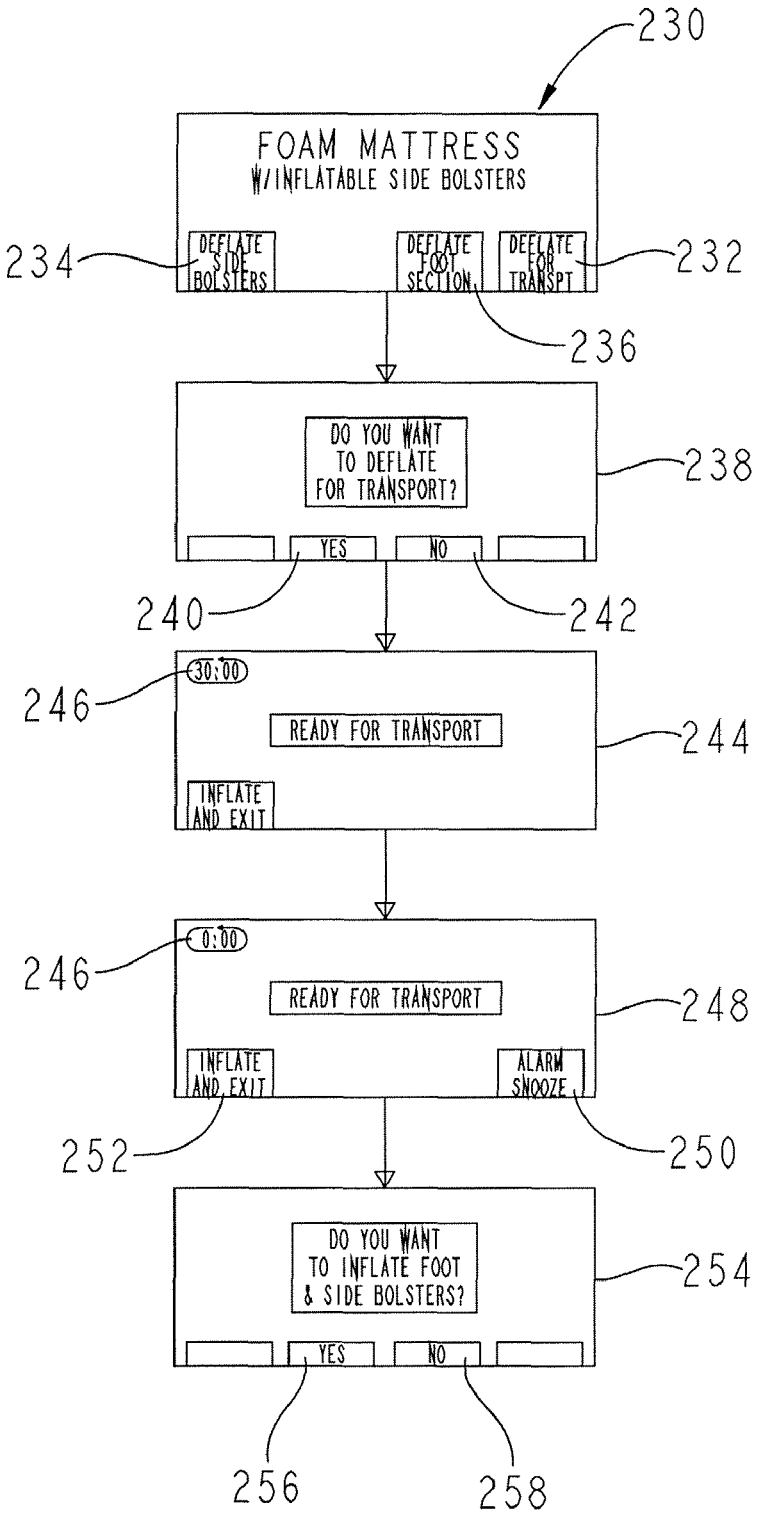
FIG. 8 is a flowchart illustrating a method of preparing a patient support including a foam support surface for transport.

Referring now to FIG. 8, a flowchart of a method of preparing the patient support 10 having a foam support surface with inflatable side bolsters and an inflatable heel section is illustrated. A screen 230 is displayed which includes a plurality of user selectable inputs including a deflate input for transport input 232. Additional inputs 234 and 236 are included to selectively deflate the side bolsters and to deflate the foot section. Upon selection of the deflate for transport input 232, the user interface displays a display screen 238, which asks the user to confirm whether transport is requested by displaying the phrase "Do you want to deflate for transport". If yes, the YES input 240 is selected at screen 238. If no, the NO input 242 is selected. Assuming the YES input 240 is selected, the display screen 244 is displayed. At this point, the controller 200 deflates the side bolsters, if present in the support surface, and the foot section of the foam support surface. Once deflated, the caregiver may move the extension assembly toward the center of the patient support to decrease the length of the bed. Likewise, if the sides are deflated the sliding panels 30 and sliding siderail panels 32 can be moved towards the center of the patient support.

A timer 246 is displayed in the display screen 244 with a time period during which transport can occur. In this case, the timer 246 is a countdown timer which is originally set to thirty minutes. Other time periods are within the scope of the present disclosure. Once the timer counts down to zero, as shown at display 248, an alarm sounds indicating that the time period has expired. Once expired, the caregiver or user can either select an alarm snooze input 250 if transport can still occur or an inflate and exit input 252. If the input 252 is selected, the display 254 is displayed which asks the user to confirm the inflation of the foot and side bolsters. If yes, the YES input 256 is selected. If no, the NO input 258 is selected. Selection of the YES input 256 inflates the foot and side bolsters. Selection of the NO input 258 returns the controller to the screen 248. If the timer is not yet zero, the timer 246 continues to countdown. If zero, the controller can sound the alarm indicating to the user that either the inflate and exit input 252 or the alarm snooze input 250 are to be selected.

If a support surface not having a compressible foot section is used, the support surface could be folded over at the foot end to accommodate movement of the deck extension 27 towards the center of the patient support.

Additional details of a control system and an inflatable support surface which can be used with the present disclosure is described in U.S. patent application entitled "Hospital Bed", having a filing date of Mar. 7, 2005, and having the Ser. No. 11/073,811, the disclosure of which is incorporated herein by reference in its entirety. Additional details of a foam support surface with an inflatable heel which can be used with the present disclosure is described in U.S. Pat. No. 6,691,346 which is herein incorporated by reference in its entirety. Additional details of a support surface which can be used with the present disclosure is described in U.S. patent application entitled "Mattress System for a Hospital Bed", filed Mar. 7, 2005, having the Ser. No. 11/073,795, and which is incorporated by reference herein in its entirety.

Although the invention has been described in detail with reference to certain preferred embodiments, variations and modifications exist within the scope and spirit of the present invention.

What is claimed is:

1. A patient support comprising:

a frame, a deck supported by the frame, the deck comprising at least a head section, a foot section spaced from the head section, and a seat section, the head and foot sections each being pivotable relative to the frame, the head, seat, and foot sections each having a top surface configured to support at least a portion of a mattress, an extension assembly coupled to the foot end of the frame, the extension assembly being configured to adjust the length of the patient support, first sliding panels, the first sliding panels being coupled to opposing lateral sides of the head section and slidable relative to the head section to expand and retract a width of the head section, each of the first sliding panels having a top surface configured to support at least a portion of the mattress, wherein the top surface of each of the first sliding panels is not above the top surface of the head section of the deck, and second sliding panels, the second sliding panels being coupled to opposing lateral sides of the foot section and slidable relative to the foot section to expand and retract a width of the foot section, each of the second sliding panels having a top surface configured to support at least a portion of the mattress, wherein the top surface of each of the second sliding panels is not above the top surface of the foot section of the deck, wherein each of the first sliding panels includes first and second spaced-apart sliding panels coupled to the head section of the deck, and wherein a first siderail assembly is mounted to only one of the pairs of sliding panels coupled to the head section.

2. The patient support of claim 1, comprising third sliding panels, the third sliding panels being coupled to opposing lateral sides of the seat section of the deck and slidable relative to the seat section of the deck to expand and retract a width of the seat section, each of the third sliding panels having a top surface configured to support at least a portion of the mattress, wherein the top surface of each of the third sliding panels is not above the top surface of the seat section of the deck.

3. The patient support of claim 1, comprising a handle movable relative to the extension assembly between a first position in which the patient support may be adjusted between a first length and a second length, and a second position spaced from the first position, in which the length of the patient support is not adjustable.

4. The patient support of claim 1, comprising an extension locator coupled to the extension assembly and configured to provide an audible sound indicating adjustment of the length of the patient support.

5. The patient support of claim 1, wherein the extension assembly is offset from the deck.

6. The patient support of claim 1, wherein the extension assembly comprises a lock, operably coupled to the frame and to the extension assembly, the lock including a first position to fix the extension assembly with respect to the frame and a second position to enable movement of the extension assembly with respect to the frame.

7. The patient support of claim 1, wherein the extension assembly comprises a slide mechanism operably coupled to the frame and to the extension assembly, the slide mechanism enabling sliding movement of the extension assembly with respect to the frame.

8. A patient support comprising:

a frame, a deck supported by the frame, the deck comprising at least a head section, the head section being pivotable relative to the frame, the head section being configured to support at least a portion of a mattress, a foot section spaced from the head section, the foot section comprising a foot deck section pivotably coupled to the deck and configured to support at least a portion of the mattress, and a length extension assembly spaced from the foot deck section and coupled to the frame, the length extension assembly configured to adjust the foot section between a first length and a second length, and a width extension assembly operably coupled to at least the head section and the foot section, the width extension assembly being configured to expand and retract the width of the patient support, wherein the foot deck section can be pivoted without affecting the position of the length extension assembly.

9. The patient support of claim 8, wherein the foot deck section is pivotable relative to the frame and the length extension assembly is slidable relative to the frame.

10. The patient support of claim 8, comprising an extension locator coupled to the length extension assembly and configured to indicate movement of the foot section to the first length by providing an audible sound when the foot section has the first length.

11. The patient support of claim 10, wherein the extension locator is configured to audibly indicate movement of the foot section to the second length.

12. The patient support of claim 8, wherein the width extension assembly includes a plurality of sliding panels configured to provide support for a support surface having a width of greater than approximately forty inches.

13. The patient support of claim 8, wherein the length extension assembly includes a first adjustment mechanism and the width extension assembly includes a second adjustment mechanism, wherein the first adjustment mechanism can be adjusted independently of the second adjustment mechanism.

14. The patient support of claim 8, wherein the length extension assembly and the foot deck section each have a top surface, and the top surface of the length extension assembly and the top surface of the foot deck section cooperate to establish a stepdown, and the stepdown is configured to provide heel pressure relief for a patient that weighs between two hundred fifty and one thousand pounds.

15. The patient support of claim 8, wherein the length of the patient support with the length extension assembly fully retracted is less than approximately ninety-one inches.

16. A bariatric patient support configured to accommodate bariatric patients of at least two hundred fifty pounds, the bariatric patient support comprising:

a frame, a deck coupled to the frame to support a support surface, a foot section coupled to the deck, the foot section comprising a length extension assembly configured to adjust the foot section between a first length and a second length, and comprising a width adjustment assembly configured to adjust the foot section between a first width and a second width, the width adjustment assembly comprising panels slidably coupled to the foot section, and a controller, to control the inflation of the support surface, including a coupler to couple to the support surface, a screen displaying a plurality of user-selectable inputs including a deflate input, and a control system embodied within the controller to deflate a portion of the support surface to shorten the width of the support surface upon activation of the deflate input, wherein the foot section can be pivoted without affecting the position of the length extension assembly.

17. The bariatric patient support of claim 16, wherein the controller comprises a user interface, to receive an input from a user, and a selector responsive to the input, to control inflation of a portion of the support surface configured to support a heel of a patient.

18. The bariatric patient support of claim 17, wherein the selector causes deflation of the portion of the support surface configured to support a heel of the patient to enable the deck to be configured at the second length.

19. The bariatric patient support of claim 16, wherein the deck comprises a locator, the locator comprising a key and an aperture configured to indicate when the patient support has reached the second length.

20. The bariatric patient support of claim 16, wherein the control system displays a timer on the screen, the timer counts down a time period after the support surface has been deflated, and the control system issues an alarm indicating that the time period has expired.

21. The bariatric patient support of claim 20, wherein the support surface inflates after the time period has expired.

22. A bed comprising:

a frame, a plurality of wheels movably supporting the frame, a high-low lift assembly coupled to the frame, a deck supported by the frame, the deck comprising a plurality of deck sections including at least a head section, a seat section, and a foot section, an extension assembly coupled to the frame and configured to adjust the foot section of the deck between a first length and a second length, the foot section of the deck being movable without affecting the position of the extension assembly, a handle movable relative to the extension assembly, and an extension locator coupled to the extension assembly, the extension locator comprising a pin, the extension locator being configured to provide a sound when the foot section moves to the first and second lengths.

23. The bed of claim 22, comprising a lock fixing the length of the deck section in one of the first and second lengths, wherein movement of the handle both unlocks the lock and adjusts the length of the deck.

24. The bed of claim 23, wherein the lock is lockable when the deck has the first length, the second length, and any length between the first length and the second length.

* * * * *